US012442279B2

(12) United States Patent
Zahran et al.

(10) Patent No.: US 12,442,279 B2
(45) Date of Patent: Oct. 14, 2025

(54) MULTI-STAGE PLUNGER HYDROCARBON LIFTING

(71) Applicant: Saudi Arabian Oil Company, Dhahran (SA)

(72) Inventors: Amr Mohamed Zahran, Al Khobar (SA); Syed Muhammad Bin Syed Taha, Dhahran (SA); Mohamed Sayed, Dammam (SA); Gustavo Alvarez, Dhahran (SA); Bagus Wahyu Setiadi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 141 days.

(21) Appl. No.: 18/240,001

(22) Filed: Aug. 30, 2023

(65) Prior Publication Data

US 2025/0075600 A1 Mar. 6, 2025

(51) Int. Cl.

| | |
|---|---|
| ***E21B 43/12*** | (2006.01) |
| ***E21B 34/06*** | (2006.01) |
| ***F04B 47/12*** | (2006.01) |

(52) U.S. Cl.

CPC ..... *E21B 43/121* (2013.01); *E21B 34/06* (2013.01); *F04B 47/12* (2013.01)

(58) Field of Classification Search

CPC ..... E21B 34/06; E21B 43/121; F04B 47/12

See application file for complete search history.

(56) References Cited

U.S. PATENT DOCUMENTS

| | | | |
|---|---|---|---|
| 2,038,426 | A | 4/1936 | Fletcher |
| 2,577,210 | A | 12/1951 | Ruska |
| 2,676,547 | A | 4/1954 | Knox |
| 2,762,308 | A | 9/1956 | Tomlinson |

(Continued)

FOREIGN PATENT DOCUMENTS

| | | |
|---|---|---|
| CA | 2164145 | 11/1996 |
| CA | 2527012 | 11/2005 |

(Continued)

OTHER PUBLICATIONS

International Search Report and Written Opinion in International Appln. No. PCT/US2024/044034, mailed on Nov. 28, 2024, 15 pages.

(Continued)

*Primary Examiner* — Daniel P Stephenson
(74) *Attorney, Agent, or Firm* — Fish & Richardson P.C.

(57) ABSTRACT

A method includes lifting a first plunger within a production string disposed within a wellbore. The production string divides the production string into multiple stages. The plunger landing assemblies include a first landing assembly and an intermediate landing assembly. The lifting includes lifting the first plunger in a first stage to lift production fluid accumulated uphole of the first plunger. The method also includes continuing to lift the first plunger until the first plunger strikes the intermediate one of the plurality of landing assemblies, allowing the production fluid to flow past the second one of the plurality of landing assemblies into a second stage. The method also includes securing the first plunger and lifting, with the production fluid accumulated uphole of a second plunger residing in the second stage, the second plunger to lift the production fluid toward the wellhead.

21 Claims, 4 Drawing Sheets

(56) References Cited

U.S. PATENT DOCUMENTS

| | | | |
|---|---|---|---|
| 3,150,596 | A | 9/1964 | Knox |
| 3,735,815 | A | 5/1973 | Myers |
| 3,749,119 | A | 7/1973 | Tausch et al. |
| 4,009,753 | A | 3/1977 | McGill et al. |
| 4,043,392 | A | 8/1977 | Gazda |
| 4,211,279 | A | 7/1980 | Isaacks |
| 4,366,861 | A | 1/1983 | Milam |
| 4,531,228 | A | 7/1985 | Kazunori et al. |
| 4,596,516 | A | 6/1986 | Scott et al. |
| 4,723,606 | A | 2/1988 | Vinzant et al. |
| 4,813,481 | A | 3/1989 | Sproul et al. |
| 4,846,281 | A | 7/1989 | Clary et al. |
| 5,211,242 | A | 5/1993 | Coleman et al. |
| 5,263,683 | A | 11/1993 | Wong |
| 5,271,725 | A | 12/1993 | Freet et al. |
| 5,389,128 | A | 2/1995 | Lopes |
| 5,431,228 | A | 7/1995 | Weingarten |
| 5,472,054 | A | 12/1995 | Hinds |
| 5,516,360 | A | 5/1996 | Normandeau et al. |
| 5,653,286 | A | 8/1997 | McCoy et al. |
| 5,823,265 | A | 10/1998 | Crow |
| 5,902,378 | A | 5/1999 | Obrejanu |
| 5,957,200 | A | 9/1999 | Majek et al. |
| 6,079,491 | A | 6/2000 | Stuebinger et al. |
| 6,089,322 | A | 7/2000 | Kelley et al. |
| 6,092,599 | A | 7/2000 | Berry et al. |
| 6,092,600 | A | 7/2000 | McKinzie |
| 6,131,660 | A | 10/2000 | Stuebinger et al. |
| 6,138,758 | A | 10/2000 | Shaw et al. |
| 6,148,923 | A | 11/2000 | Casey |
| 6,155,345 | A | 12/2000 | Lee et al. |
| 6,179,054 | B1 | 1/2001 | Stewart |
| 6,179,056 | B1 | 1/2001 | Smith |
| 6,216,788 | B1 | 4/2001 | Wilson |
| 6,367,547 | B1 | 4/2002 | Towers et al. |
| 6,481,499 | B2 | 11/2002 | Lopes |
| 6,494,258 | B1 | 12/2002 | Weingarten |
| 6,571,868 | B2 | 6/2003 | Victor |
| 6,705,404 | B2 | 3/2004 | Bosley |
| 6,736,880 | B2 | 5/2004 | Ford et al. |
| 6,808,020 | B2 | 10/2004 | Garcia |
| 6,830,108 | B2 | 12/2004 | Rogers |
| 6,932,160 | B2 | 8/2005 | Murray |
| 6,945,762 | B2 | 9/2005 | Williams |
| 6,966,366 | B2 | 11/2005 | Rogers |
| 7,080,692 | B1 | 7/2006 | Kegin |
| 7,188,670 | B2 | 3/2007 | Amies et al. |
| 7,337,854 | B2 | 3/2008 | Horn et al. |
| 7,665,528 | B2 | 2/2010 | Ross et al. |
| 7,878,251 | B2 | 2/2011 | Giacomino et al. |
| 7,954,545 | B2 | 6/2011 | Hearn et al. |
| 8,136,600 | B2 | 3/2012 | Fowler |
| 8,181,706 | B2 | 5/2012 | Tanton |
| 8,286,717 | B2 | 10/2012 | Giroux et al. |
| 8,322,434 | B2 | 12/2012 | Fielding |
| 8,424,611 | B2 | 4/2013 | Smith |
| 8,475,147 | B2 | 7/2013 | Losinske et al. |
| 8,893,777 | B1 | 11/2014 | Garrett |
| 8,950,473 | B2 | 2/2015 | Smith |
| 8,985,221 | B2 | 3/2015 | Mazzanti |
| 9,109,424 | B2 | 8/2015 | Jefferies et al. |
| 9,206,676 | B2 | 12/2015 | Quigley et al. |
| 9,322,251 | B2 | 4/2016 | Mazzanti |
| 9,470,073 | B2 | 10/2016 | Xiao et al. |
| 9,518,458 | B2 | 12/2016 | Ellithorp et al. |
| 9,587,444 | B2 | 3/2017 | Agarwal |
| 9,631,472 | B2 | 4/2017 | Reid et al. |
| 9,670,758 | B2 | 6/2017 | Wilson |
| 9,765,608 | B2 | 9/2017 | Sims |
| 9,915,256 | B2 | 3/2018 | Bebak et al. |
| 9,970,420 | B2 | 5/2018 | Wang et al. |
| 10,174,752 | B2 | 1/2019 | Downing |
| 10,364,658 | B2 | 7/2019 | Michel |
| 10,443,354 | B2 | 10/2019 | Murphree et al. |
| 10,697,287 | B2 | 6/2020 | Romer et al. |
| 10,920,559 | B2 | 2/2021 | Zahran |
| 11,255,170 | B2 | 2/2022 | Zahran |
| 11,261,713 | B2 | 3/2022 | Zahran |
| 11,261,859 | B2 | 3/2022 | Zahran |
| 11,542,797 | B1 | 1/2023 | Zahran et al. |
| 2002/0162662 | A1 | 11/2002 | Passamaneck et al. |
| 2003/0215337 | A1 | 11/2003 | Lee |
| 2004/0238179 | A1 | 12/2004 | Murray |
| 2004/0251032 | A1 | 12/2004 | Luke et al. |
| 2005/0053503 | A1 | 3/2005 | Gallant |
| 2005/0194149 | A1 | 9/2005 | Giacomino |
| 2005/0199551 | A1 | 9/2005 | Gordon |
| 2006/0113072 | A1 | 6/2006 | Lee |
| 2006/0249284 | A1 | 11/2006 | Victor |
| 2006/0283791 | A1 | 12/2006 | Ross |
| 2008/0135239 | A1 | 6/2008 | Edwards |
| 2008/0210429 | A1 | 9/2008 | McMillin et al. |
| 2008/0230230 | A1 | 9/2008 | Giacomino |
| 2009/0038788 | A1 | 2/2009 | Farris |
| 2010/0038071 | A1 | 2/2010 | Scott et al. |
| 2010/0147514 | A1 | 6/2010 | Swaringin |
| 2010/0294507 | A1 | 11/2010 | Tanton |
| 2011/0073322 | A1 | 3/2011 | Smith et al. |
| 2011/0132593 | A1 | 6/2011 | Phloi-montri |
| 2012/0080196 | A1 | 4/2012 | Laing |
| 2012/0318524 | A1 | 12/2012 | Lea |
| 2013/0068455 | A1 | 3/2013 | Brown et al. |
| 2013/0319661 | A1 | 12/2013 | Xiao et al. |
| 2015/0000982 | A1 | 1/2015 | McDowell |
| 2015/0233228 | A1 | 8/2015 | Roth et al. |
| 2015/0240596 | A1 | 8/2015 | Horwell |
| 2015/0275633 | A1 | 10/2015 | Tolman et al. |
| 2015/0292307 | A1 | 10/2015 | Best |
| 2016/0090827 | A1* | 3/2016 | Agarwal ..... E21B 43/13 166/311 |
| 2016/0097265 | A1* | 4/2016 | Bishop ..... E21B 43/121 166/372 |
| 2016/0130922 | A1 | 5/2016 | Wilson |
| 2016/0222773 | A1 | 8/2016 | Sims |
| 2016/0312589 | A1 | 10/2016 | Decarlo |
| 2016/0333681 | A1 | 11/2016 | Mazzanti |
| 2016/0341195 | A1 | 11/2016 | Roycroft |
| 2017/0044882 | A1 | 2/2017 | Casey et al. |
| 2017/0044883 | A1 | 2/2017 | Wilkinson et al. |
| 2017/0081952 | A1 | 3/2017 | Osborne et al. |
| 2017/0096884 | A1 | 4/2017 | Michel |
| 2017/0218722 | A1 | 8/2017 | Gordon |
| 2017/0328189 | A1 | 11/2017 | Wang et al. |
| 2018/0196005 | A1 | 7/2018 | Fanini et al. |
| 2018/0334890 | A1 | 11/2018 | Stadler et al. |
| 2019/0277118 | A1 | 9/2019 | Boyd |
| 2019/0292892 | A1 | 9/2019 | Zahran |
| 2020/0141214 | A1 | 5/2020 | Kuykendall |
| 2020/0386087 | A1 | 12/2020 | Ferreira Gaglioti |
| 2021/0032964 | A1 | 2/2021 | Zahran |
| 2021/0071505 | A1 | 3/2021 | Boyd |
| 2021/0301635 | A1 | 9/2021 | Zahran |
| 2023/0193728 | A1 | 6/2023 | Green |
| 2024/0052728 | A1 | 2/2024 | Zahran et al. |
| 2024/0159233 | A1 | 5/2024 | Taha et al. |
| 2024/0159234 | A1 | 5/2024 | Taha et al. |
| 2025/0075600 | A1* | 3/2025 | Zahran ..... E21B 34/06 |

FOREIGN PATENT DOCUMENTS

| | | |
|---|---|---|
| CN | 2336113 | 9/1999 |
| CN | 201314221 | 9/2009 |
| CN | 203035167 | 7/2013 |
| CN | 203603854 | 5/2014 |
| CN | 205189837 | 4/2016 |
| CN | 109209305 | 1/2019 |
| CN | 216406782 | 4/2022 |
| EP | 2142755 | 3/2016 |
| GB | 2257185 | 1/1993 |
| GB | 2409691 | 2/2007 |
| GB | 2452370 | 3/2009 |
| WO | WO 2015167895 | 11/2015 |

(56) References Cited

FOREIGN PATENT DOCUMENTS

| | | |
|---|---|---|
| WO | WO 2016057011 | 4/2016 |
| WO | WO 2021021794 | 2/2021 |
| WO | WO 2022052963 A1 | 3/2022 |

OTHER PUBLICATIONS

U.S. Appl. No. 18/239,625, Zahran et al., filed Aug, 29, 2023.
U.S. Appl. No. 18/523,267, Setiadi et al., filed Nov. 29, 2023.
U.S. Appl. No. 18/523,293, Setiadi et al., filed Nov. 29, 2023.
U.S. Appl. No. 18/523,308, Setiadi et al., filed Nov. 29, 2023.
Apergy Unlocking Energy, "PCS Multi-Stage Plunger Lift Equipment Catalog, Plunger Lift: Multi-Stage Plunger Tools," Oct. 2018, 2 pages.
Don-nan.com [online], "Gas Separator: Packer-style gas separator," available on or before Apr. 10, 2012, retrieved on Sep. 7, 2018, retrieved from URL <https://irp-cdn.multiscreensite.com/4497d96c/files/uploaded/DN%20GS%20PS.pdf>, 1 page.
Gray, "Well-Performance Diagnostics Using Smart Plunger Technology," SPE 120596-MS, SPE International, SPE Production and Operations Symposium, Oklahoma City, Oklahoma, Apr. 2009, 10 pages.
Harbison-Fischer, "Variable Slippage Pump," 2001, retrieved on Mar. 15, 2021, retrieved from URL <http://apergycdn.5thring.co.uk/HF_Variable_Slippage_Pump.pdf>, 8 pages.
Lufkin Oilfield Products Group, "2008/2009 General Catalog," 2008-2009, 72 pages.
McCoy et al., "Downhole Gas Separators: A Laboratory and Field Study," Presented at the Gas Well De-Liquification Workshop, Denver, Colorado, Feb. 27-Mar. 1, 2006, 47 pages.
McCoy et al., "Improved Downhole Gas Separators," Presented at the Southwestern Petroleum Short Course, Lubbock, Texas, Apr. 7-8, 1998, 11 pages.
Odessaseparator.com [online], "OSI: Fluid Conditioning Systems," Available on or before Apr. 7, 2017, via Internet Archive: Wayback Machine URL <https://web.archive.org/web/20170407235934/http://www.odessaseparator.com/products>, retrieved on Sep. 7, 2018, retrieved from URL <https://www.odessaseparator.com/products>, 4 pages.
Samayamantula, "An Innovative Design for Downhole Gas Separation," Don-Nan Pump and Supply Company, Presented at the Oil and Gas Technology Webinar hosted by IEEE, Engineering 360, May 22, 2013, 16 pages.
Valbuena et al., "Defining the Artificial Lift System Selection Guidelines for Horizontal Wells," SPE-181229-MS, Society of Petroleum Engineers (SPE), Presented at the SPE North American Artificial Lift Conference and Exhibition, The Woodlands, Texas, Oct. 25-27, 2016, 20 pages.
Xu et al., "Rod Pumping Deviated Wells," Lufkin Automation, 2005, 14 pages.

* cited by examiner

MULTI-STAGE PLUNGER HYDROCARBON LIFTING

TECHNICAL FIELD

This disclosure relates to artificial lift systems, and more particularly to plunger lift systems.

BACKGROUND

Plunger lift systems are used to produce hydrocarbons and deliquefy natural gas wellbores. Plunger lift systems use one or more plungers that are moved up and down along a wellbore by the natural pressure of the well or by injecting fluid from the surface of the wellbore to lift hydrocarbons accumulated above the plunger. Methods and equipment to improve plunger lift systems are sought.

SUMMARY

Implementations of the present disclosure include a method that includes lifting a first plunger within a production string disposed within a wellbore formed in a subterranean zone. The production string extends from a wellhead and includes multiple plunger landing assemblies that reside in the production string and divide the production string into multiple stages. Each stage includes a portion of the production string between two consecutive plunger landing assemblies or a plunger landing assembly and the wellhead. The plunger landing assemblies include a first landing assembly and an intermediate landing assembly residing between the first landing assembly and the wellhead. The lifting includes lifting the first plunger in a first stage of the plurality of stages to lift production fluid accumulated uphole of the first plunger. The method also includes continuing to lift the first plunger until the first plunger strikes the intermediate one of the plurality of landing assemblies, allowing the production fluid to flow past the second one of the plurality of landing assemblies into a second stage of the plurality of stages. The method also includes securing, with the catcher, the first plunger. The method also include lifting, with the production fluid accumulated uphole of a second plunger residing in the second stage, the second plunger to lift the production fluid toward the wellhead.

In some implementations, production string includes one or more sensors at or near the catcher. The catcher is controllable as a function of sensor feedback from the one or more sensors, and the securing includes securing, as a function of the sensor feedback, the first plunger.

In some implementations, the catcher is fluidly coupled to an actuator or pump through a hydraulic line, the actuator or pump disposed at or near a terranean surface of the wellbore and coupled to a controller electrically coupled to the sensors, and the securing includes actuating, by the controller, the actuator or pump as a function of the sensor feedback to move the catcher by moving hydraulic fluid through the hydraulic line.

In some implementations, the method also includes releasing the first plunger, allowing the first plunger to fall and land on the first landing assembly for fluid to accumulate on the first plunger.

In some implementations, the first plunger includes a bypass plunger defining a fluid pathway extending through the plunger, allowing the production fluid to flow uphole through the first plunger as the first plunger falls in the production string within the first stage. In some implementations, the first plunger includes a bypass valve configured to close when the first plunger lands on the first landing assembly, blocking the fluid pathway, and open when the first plunger reaches the intermediate landing assembly. In some implementations, the second stage is defined between the intermediate landing assembly and the wellhead, and the lifting includes lifting the production fluid to the terranean surface of the wellbore through the wellhead.

In some implementations, the production string includes a retrievable tool residing downhole of and adjacent the intermediate landing assembly, the retrievable tool including an outwardly projecting pocket defining a fluid pathway extending from the first stage to the second stage, and wherein continuing to lift the first plunger includes lifting the first plunger to push, with the first plunger, the production fluid along the fluid pathway into the second stage.

Implementations of the present disclosure include a method that includes receiving, by a system including one or more computers in one or more locations, first sensor feedback from one or more sensors attached to a production string disposed within a wellbore. The method also includes transmitting, by the system and as a function of the first sensor feedback, instructions to a controller to activate the controller. The controller actuates, as a function of the instructions, an actuator or pump fluidly coupled to a downhole catcher to actuate the downhole catcher and catch a first plunger with the downhole catcher. The production string includes multiple plunger landing assemblies residing in the production string and dividing the production string into multiple stages. Each stage including a portion of the production string between two consecutive plunger landing assemblies or a plunger landing assembly and the wellhead. The plunger landing assemblies include a first landing assembly and an intermediate landing assembly residing between the first landing assembly and the wellhead, the downhole catcher residing downhole of the intermediate landing assembly in a first stage of the plurality of stages.

In some implementations, the method also includes transmitting, by the system and as a function of a second sensor feedback, instructions to a controller to activate the controller, the controller configured to actuate, as a function of the instructions, the actuator or pump to actuate the catcher and release the first plunger after production fluid uphole of the first plunger has been flowed from the first stage to the second stage.

In some implementations, the second sensor feedback includes one of pressure feedback, temperature feedback, or motion feedback.

In some implementations, the controller is configured to actuate a pump coupled to a hydraulic line, and the transmitting includes transmitting instructions to the controller to cause the controller to actuate the pump to move hydraulic fluid along the hydraulic line to move the downhole catcher.

In some implementations, the first sensor feedback includes motion feedback.

Implementations of the present disclosure include a wellbore assembly that includes a production string configured to be disposed within a wellbore formed in a subterranean zone. The production string is configured to be fluidly coupled to a wellhead residing at a terranean surface of the wellbore. The production string also includes multiple plunger landing assemblies residing in the production string and dividing the production string into a plurality of stages. Each stage includes a portion of the production string between two consecutive plunger landing assemblies or a plunger landing assembly and the wellhead. The plunger landing assemblies including a first landing assembly and an intermediate landing assembly residing between the first landing assembly and the wellhead. The production string also includes a plurality of plungers, each plunger configured to reside in the production string in a respective one of the plurality of stages. The production string also includes a catcher configured to reside downhole of the intermediate landing assembly and configured to catch a first plunger of the plurality of plungers after the first plunger has been lifted to push production fluid uphole past a second plunger resting on the intermediate landing assembly.

In some implementations, includes the plurality of stages includes a first stage and a second stage uphole of and adjacent the first stage, the first stage defined between the first landing assembly and the intermediate landing assembly, the catcher and the first plunger residing in the first stage.

In some implementations, the wellbore assembly also includes a retrievable tool residing in the first stage downhole of and adjacent the intermediate landing assembly. The retrievable tool includes an outwardly projecting pocket defining a fluid pathway extending from the first stage to the second stage. The first plunger is along the first stage to push the production fluid uphole along the fluid pathway into the second stage to accumulate on the second plunger. In some implementations, the retrievable tool includes one or more sensors and the catcher. The catcher is controllable as a function of sensor feedback from the one or more sensors. In some implementations, the catcher is fluidly coupled to an actuator or pump through a hydraulic line. The actuator or pump is disposed at or near a terranean surface of the wellbore and coupled to a controller electrically coupled to the sensors. The securing includes actuating, by the controller, the actuator or pump as a function of the sensor feedback to move the catcher by moving hydraulic fluid through the hydraulic line.

In some implementations, the first plunger is a bypass plunger defining a fluid pathway extending through the plunger, allowing the production fluid to flow uphole through the first plunger as the first plunger falls in the production string within the first stage.

In some implementations, the first plunger includes a bypass valve configured to close when the first plunger lands on the first landing assembly, blocking the fluid pathway, and open when the first plunger reaches the intermediate landing assembly.

Particular implementations of the subject matter described in this specification can be implemented so as to realize one or more of the following advantages. For example, the multi-stage plunger lift system of the present disclosure enables the use of bypass plungers that can descend along the wellbore without shutting in the wellbore, which can minimize the shut in time and maximize production time. Additionally, the multi-stage plunger lift system of the present disclosure can increase the liquid lifting capacity of low gas-liquid ratio (GLR) wells. Also, the plunger lift system of the present disclosure enables producing wells with lower GLR (e.g., GLR below 450 MMSCF/bbl/1000 feet depth) and increases the production capacity to around 150 to 200 barrels per day (BPD). Thus, the plunger lift system of the present disclosure can increase the operating envelop of the plunger lift application to produce low GLR wells with much higher liquid lifting capacity.

DETAILED DESCRIPTION OF THE DISCLOSURE

The present disclosure describes a plunger lift system that includes a downhole catcher and a retrievable tool. Plunger lift systems use a form of intermittent gas lift method that includes using gas pressure buildup in the casing-tubing annulus to push a plunger up from the bottom of the plunger. Plunger lift is an artificial lift mechanism for high gas liquid ratio (GLR) oil wells and for gas well deliquification. Plunger lift systems use solid plungers or bypass plungers (e.g., flow through plungers) to act as interface between the wellbore fluid being lifted and the fluid lifting the plunger. Plunger lift systems can utilize the reservoir's natural energy to lift up the fluid accumulated above the plunger. In some aspects, the plunger can be lifted by fluid injected from the surface through the wellbore annuls and up the wellbore below the plunger.

The present disclosure describes a multi-stage plunger lift system in which the production tubing is divided into multiple stages each including a respective plunger. Similar to a bucket brigade, each plunger lifts an amount of production fluid to a following plunger which then lifts the production fluid to a subsequent plunger (or the surface) and so on, until the production fluid has been lifted to the surface of the wellbore.

To utilize bypass plungers in a multi-stage system, the bypass plunger is caught after the plungers has been lifted. Once caught by the catcher, the production fluid can continue to be lifted briefly from the first stage to the second stage before the bypass plunger is released again. The downhole catcher is controllable as a function of sensor feedback to catch the plunger upon arrival. This allows using flow-through continuous flow plungers, minimizing the long shut in time often needed with solid plungers, and thereby maximizing production time. Specifically, the catcher released the plunger after a production cycle, allowing the plunger to fall through any fluid remaining in the tube in the first stage, which means that there's no need to shut in the wellbore for the plunger to descend.

The multi-stage plunger lift system of the present disclosure enables the production of wells with lower GLR (e.g., with a GLR of below 450 MMSCF/bbl/1000 feet depth) with high liquid lifting capacity that can reach 150-200 barrels per day (BPD). This is achieved by utilizing tubing retrievable multistage tool that can be preinstalled with the production tubing string and incorporates a downhole catcher. The tubing retrievable multistage tool enables the use of flow bypass plungers that enable a faster lift process.

Figure 1:
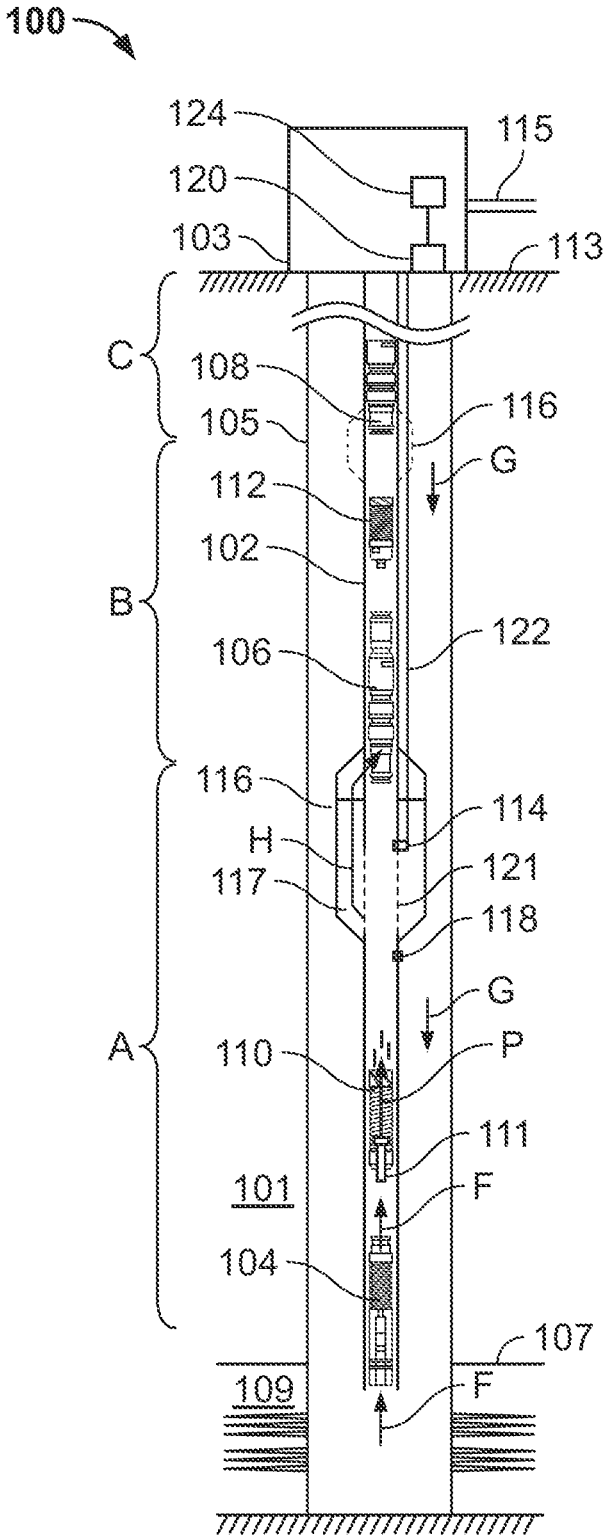
FIG. 1 shows a front schematic view, partially cross-sectional, of a multi-stage plunger lift system according to implementations of the present disclosure, with a first plunger falling.

FIG. 1 shows a wellbore assembly 100 (e.g., a plunger lift system) that includes a production string 102, multiple plunger assemblies 104, 106, 108, multiple plungers 110, 112, and one or more retrievable tools 116 each including a catcher 114. The production string 102 resides within a wellbore 105. In some aspects, the wellbore 105 extends through a subterranean zone 101 that includes a geologic formation 107. For example, the wellbore 105 extends down from a surface 113 (e.g., a terranean surface) of the wellbore 105 into a geologic formation 107 such as a subterranean layer of rock. The geologic formation 101 includes a reservoir 109 from which production fluid "F" (e.g., hydrocarbons) can be extracted.

The production string 102 is fluidly coupled to and extends downhole from a wellhead 103 or wellhead equipment. The wellhead included (or is attached to) a lubricator (not shown) that has a catcher to catch the plunger that lifts hydrocarbons to the surface. In some aspects, the produced hydrocarbons are routed from the wellhead 103 and/or lubricator to a flow line 115 that is connected to a reservoir at the surface 113 of the wellbore 105.

The plunger landing assemblies 104, 106, 108 reside in the production string 102 at multiple locations. The group of plunger landing assemblies includes at least a first landing assembly 104 (e.g., a lowermost landing assembly) and an intermediate landing assembly 106 residing between the first landing assembly and the wellhead 103. In some aspects, the production string 102 includes more than two landing assemblies, such as a third landing assembly 108.

The plunger landing assemblies 104, 106, 108 divide the production string 102 into multiple stages "A," "B," "C," etc. Each stage includes a portion of the production string between two consecutive plunger landing assemblies or, in the case of the uppermost stage "C", between a plunger landing assembly 108 and the wellhead 103. One of the multiple plungers 110, 112 resides in a respective stage. For example, a first plunger 110 resides in the first stage "A" between the lowermost landing assembly 104 and the intermediate landing assembly 106, and a second plunger 112 resides in the second stage "B," between the intermediate landing assembly 106 and another landing assembly 108 (or the wellhead 103).

The plungers 110, 112 lift production fluid in stages. For example, as further described in detail below with respect to FIGS. 2-4, the first plunger 110 lifts the production fluid "F" along the first stage "A" and into the second stage "B," then the second plunger 112 lifts the production fluid "F" along the second stage "B" into the third stage "C" (or to the surface), and so on until the production fluid "F" reaches the surface 113.

In some aspects, the plungers 110, 112 are bypass plungers (e.g., flow through plungers) that allow fluid to pass through them. For example, the plungers 110, 112 define a fluid pathway "P" that extends through the plunger, either through an inner channel (e.g., a bore) or through the exterior surface of the plunger body. Production fluid "F" can flow uphold through the plunger 110 along the fluid pathway "P" as the plunger 110 falls, stops, or moves up through the production string 102. The bypass plungers can fall within the wellbore at high speeds through fluid compared to a solid plunger, which descends slower (or can't descend) through production fluid. In some aspects, the production fluid "F" passes through the plunger substantially uninterrupted as the plunger falls in the production string 102.

The plungers 110, 112 can have a bypass valve 111 that closes when the plunger lands on the first landing assembly 104, blocking the fluid pathway "P," and opens when the plunger reaches the intermediate landing assembly 106. In some aspects, the valve opens and closes automatically upon impact, or the the retrievable tool opens (or helps open) the valve 111 by catching the plunger on free fall and causing the valve to open under inertia.

Each plunger 110, 112 is dropped from the top of tis respective stage and falls through the fluid "F" in the production string 102, allowing fluid to flow across the plunger in an uphole direction until the plunger lands on its respective landing assembly. Once the plunger lands, the plunger closes at the impact, preventing fluid from flowing across the plunger in any direction. Thus, pressurized gas "G" (or the natural downhole pressure of the wellbore fluids) entering the production string 102 from the downhole end of each respective plunger pushes up the plunger and causes the plunger to push the accumulated fluid "F" uphole to the terranean surface 113.

In some aspects, each retrievable tool 116 resides adjacent each intermediate landing assembly 106, 108. For example, the lowermost retrievable tool 116 resides in the first stage "A" and is positioned adjacent and downhole of the intermediate landing assembly 106. The retrievable tool 116 can b or include a sub coupled to the production string 102. The tool 112 can be retrieved from the surface of the wellbore by a wireline or slickline to allow inspection and maintenance.

The tool 116 has an outwardly projecting pocket 117 or housing that defines a fluid pathway "H" extending from the first stage "A" to the second stage "B." Specifically, the tool 116 has slots or perforations 121 that allow fluid to flow from the first stage "A" into the pocket, and from the pocket into the second stage "B." As further described in detail below with respect to FIG. 3, the fluid "F" pushed uphole by the first plunger 110 flows through the fluid pathway "H" from the first stage "A" to the second stage "B." Thus, the first plunger 110 pushes the production fluid "F" into the second stage "B" to accumulate on top of the second plunger 112.

In some aspects, the retrievable tool 116 also includes a catcher 114 and one or more sensors 118 that help detect the presence of the plunger 110. The catcher 114 is controllable as a function of sensor feedback from the one or more sensors 118. In some aspects, the catcher can be hydraulically, electrically, or pneumatically controlled from the surface 113 of the wellbore. For example, the catcher is fluidly coupled to a fluid moving device 120 such as an actuator or pump through a hydraulic line 122.

In some aspects, the actuator or pump 120 reside at or near a terranean surface 113 of the wellbore 102. The actuator or pump 120 are coupled to a controller 124 (e.g., a controller that is part of a computer system) that is electrically coupled to the sensor 118. The controller receives sensor feedback and actuates the actuator or pump 120 as a function of the sensor feedback to move the catcher 118 by moving hydraulic fluid through the hydraulic line 122. For example, the catcher 114 has valve or mandrel (not shown) that is hydraulically activated or and moved under fluid pressure to activate and deactivate the catcher. Alternatively, the catcher 114 can be operated electrically by an electric actuator controlled in-situ or from the surface.

As shown in FIG. 1, during production, the first plunger 110 is dropped (e.g., released by the catcher 111) along the first stage "A." The production fluid "F" enters the production string 102 and flows past the first landing assembly 104. As the plunger 110 falls, the production fluid "F" accumulates on top of the plunder 110.

Figure 2:
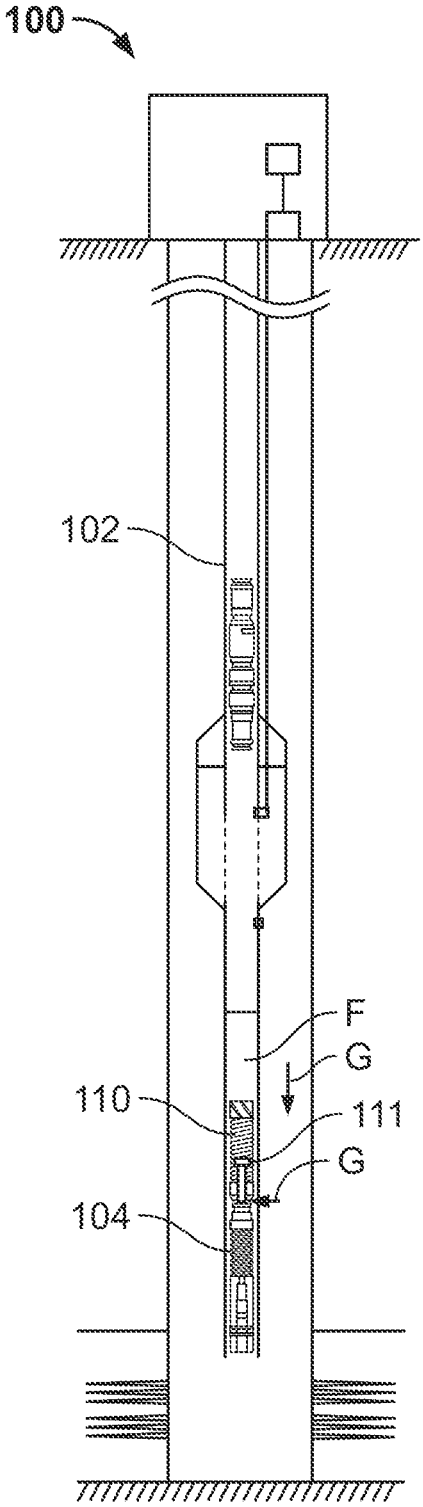
FIG. 2 shows a front schematic view, partially cross-sectional, of the multi-stage plunger lift system in FIG. 1 with the first plunger landed.

As shown in FIG. 2, once the plunger 110 lands on the first landing assembly 104, the fluid "F" accumulates on top of the first plunger 110. In some aspects, the bypass valve 111 of the plunger 110 closes upon impact (e.g., a gate drops under the energy of the impact to close an aperture) to prevent the production fluid "F" from falling downhole through the plunger 110. To lift the first plunger 110, gas "G" (or the natural pressure of the wellbore fluids) from the surface is injected and enters the string 102 through an aperture below the plunger 110 to lift the plunger uphole toward the second stage.

Figure 3:
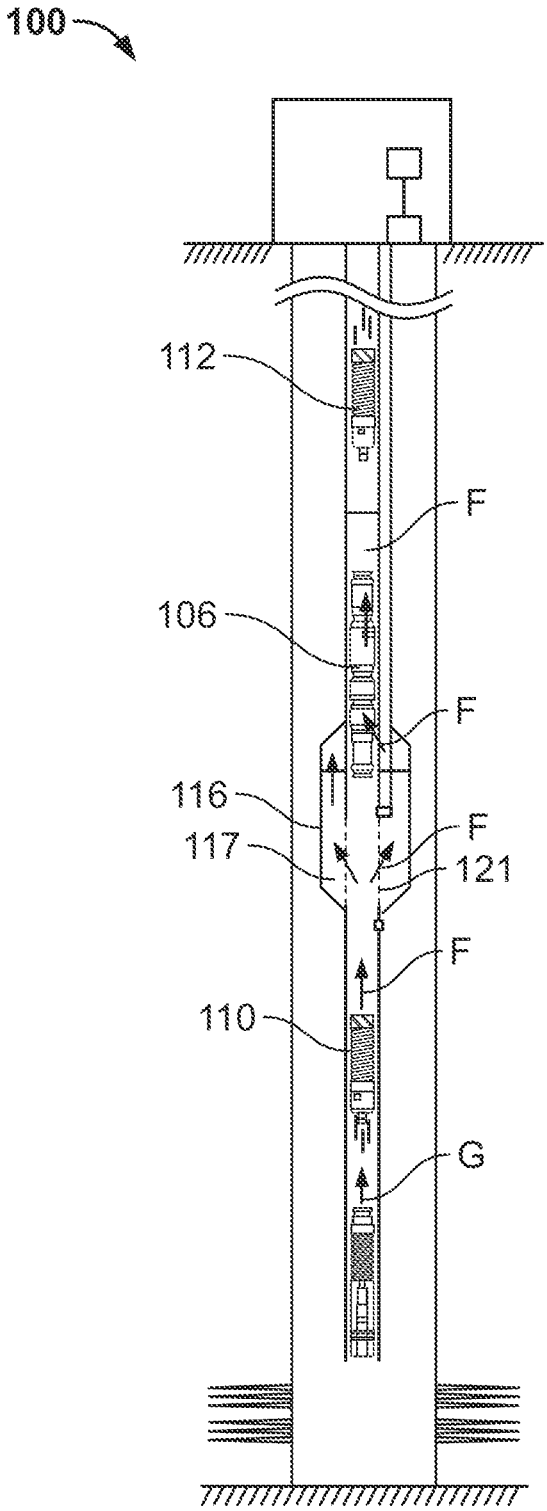
FIG. 3 shows a front schematic view, partially cross-sectional, of the multi-stage plunger lift system in FIG. 1 with the first plunger being lifted.

As shown in FIG. 3, the gas "G" lifts the plunger 110 and the plunger 110 lifts the production fluid "F." As the production fluid "F" is pushed uphole by the first plunger 110, the production fluid "F" reaches the retrievable tool 116. The retrievable tool 116 has apertures 121 through which the production fluid "F" enters the pocket 117 of the tool 116. The pocket is fluidly coupled to the second state such that, as the first plunger 110 pushes the fluid "F" uphole, the production fluid in the pocket 117 flows uphole (e.g., through the intermediate landing assembly 106) and to the second stage.

In some aspects, as shown in FIG. 1, the second plunger 112 is dropped to land on the intermediate landing assembly 106 after (or before) the production fluid "F" has been transferred from the first state to the second stage by the first plunger 110. The first plunger reaches and stops at the downhole end of the intermediate landing assembly 106, while the second plunger 112 lands on a top surface of the intermediate landing assembly 106.

Figure 4:
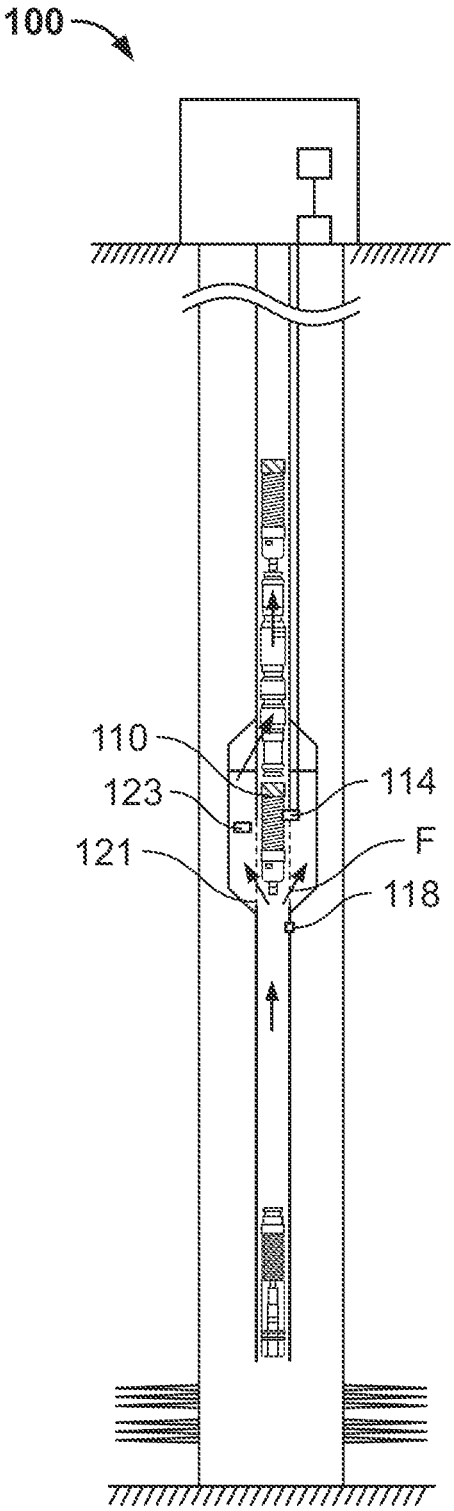
FIG. 4 shows a front schematic view, partially cross-sectional, of the multi-stage plunger lift system in FIG. 1 with the first plunger secured by a catcher.

As shown in FIG. 4, once the first plunger 110 reaches the intermediate landing assembly 106, the catcher 118 catches the plunger 110, preventing the plunger 110 from falling downhole. The sensor 118 detects the presence of the plunger 110 as the plunger 110 passes in front of the sensor 118. The sensor 118 transmits sensor feedback in or near real time to the one or more computers at the surface of the wellbore, and the computers transmit instructions to the controller of the hydraulic system information to actuate the catcher 114 and catch the plunger 110. The controller also moves the catcher 114 to disengage the plunger 110 after the production fluid "F" has been moved to the second state. For example, a second sensor 123 transmits information (e.g., temperature, pressure, flow rate, etc.) that is used by the computers to determine that there is no more production fluid "F" being flowed through to the second stage. As a function of that determination, the computers send instructions to the controller to retract or open the catcher and allow the plunger 110 to fall back down.

In some aspects, as shown in FIG. 4, production fluid "F" pushing the plunger uphole can continue to flow (be produced) from the first stage to the second stage after the plunger 110 has been caught. For example, at least a portion of the apertures 121 are exposed to the fluid "F" dowhole of the plunger 110 when the plunger 110 is caught by the catcher 114 to allow the fluid "F" to flow to the pocket and from the pocket to the second stage.

In some aspects, the controller 124 can be implemented as a distributed computer system disposed partly at the surface and partly within the wellbore. The computer system includes one or more processors and a computer-readable medium storing instructions executable by the one or more processors to perform the operations described here. In some implementations, the controller 124 can be implemented as processing circuitry, firmware, software, or combinations of them. The controller 124 transmits signals to the catcher to catch and release the plunger 110.

In some aspects, the sensor 118 is a motion sensor. Additionally, the sensor 118 can include one or more sensors that sense movement, pressure, flow rate, noise, or other parameters that can be used to determine the location (or presence) of the plunger 110.

Figure 5:
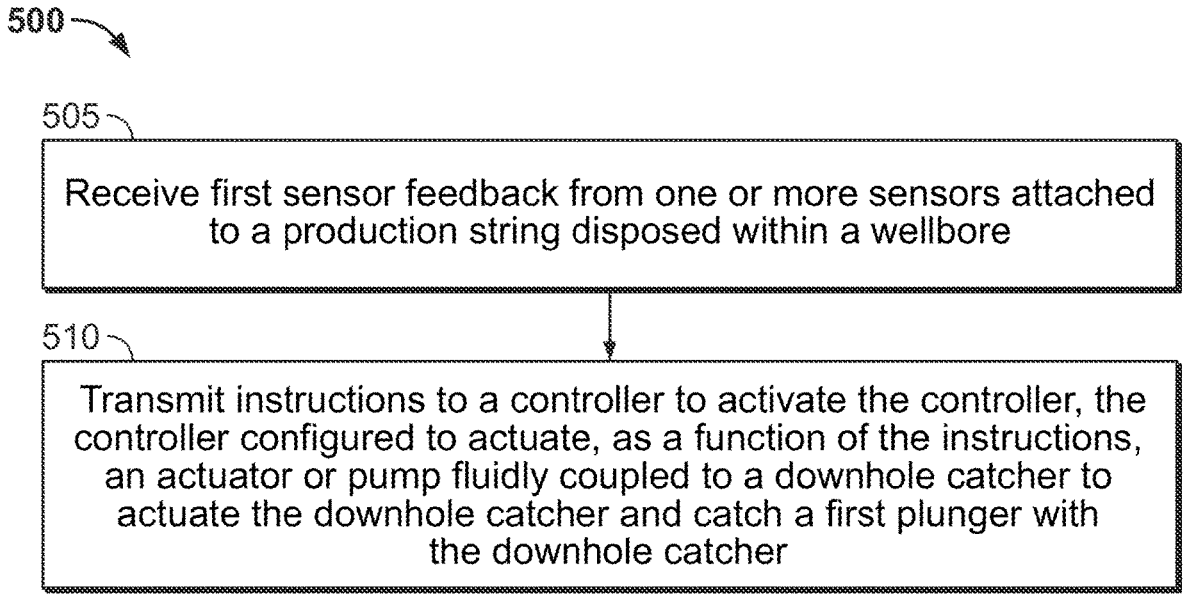
FIG. 5 is a flow chart of a method of lifting production fluid.

FIG. 5 shows a flow chart of a method (500) of producing hydrocarbons. The method includes receiving, by a system that has one or more computers in one or more locations, first sensor feedback from one or more sensors attached to a production string disposed within a wellbore (505). The method also includes transmitting, by the system and as a function of the first sensor feedback, instructions to a controller to activate the controller, the controller configured to actuate, as a function of the instructions, an actuator or pump fluidly coupled to a downhole catcher to actuate the downhole catcher and catch a first plunger with the downhole catcher (510).

Figure 6:
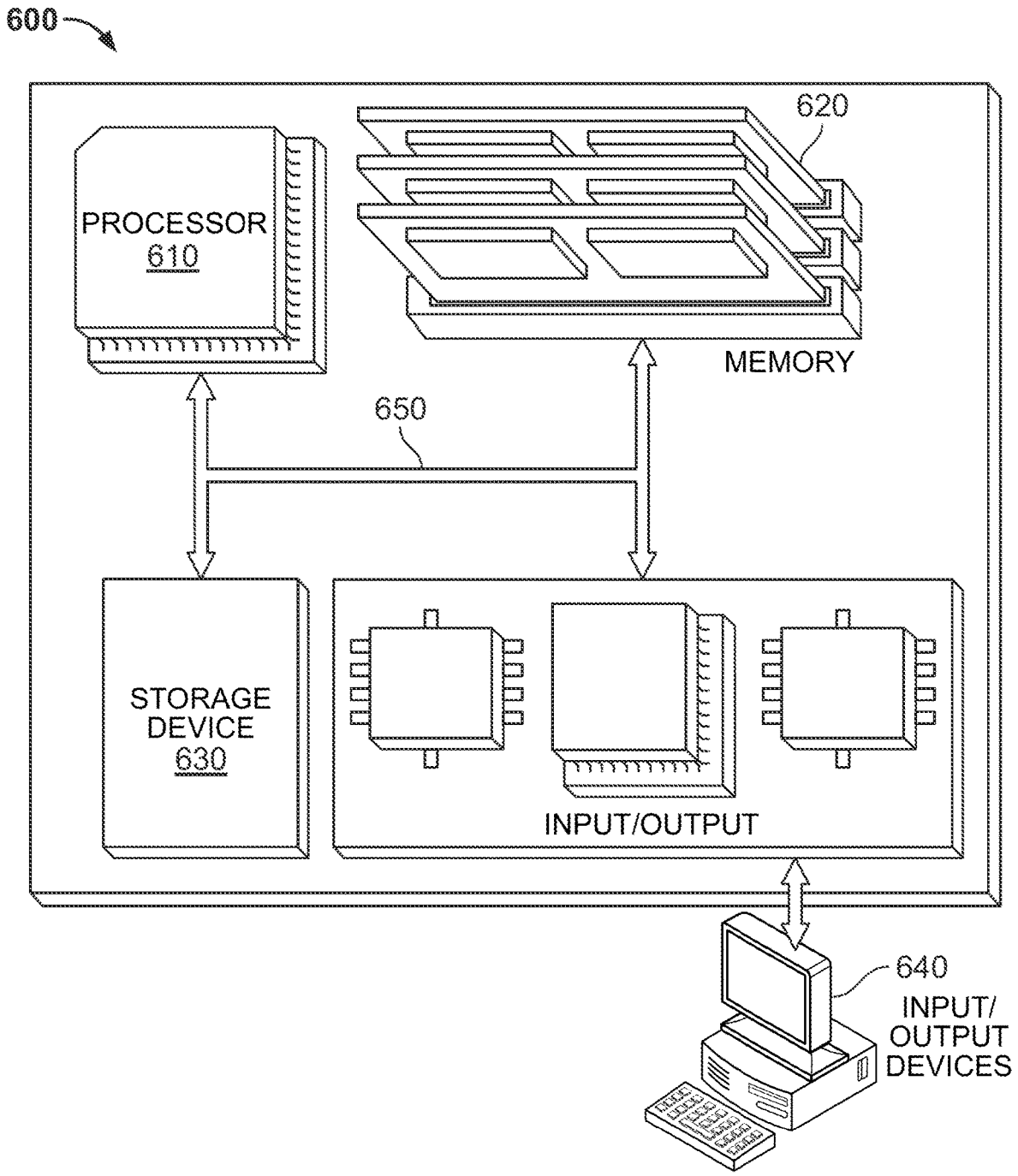
FIG. 6 is a schematic illustration of an example control system or controller for a multi stage plunger system.

FIG. 6 is a schematic illustration of an example control system or controller for a multi stage plunger system according to the present disclosure. For example, the controller 600 may include or be part of the controller 124 shown in FIG. 1. The controller 600 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 600 includes a processor 610, a memory 620, a storage device 630, and an input/output device 640. Each of the components 610, 620, 630, and 640 are interconnected using a system bus 650. The processor 610 is capable of processing instructions for execution within the controller 600. The processor may be designed using any of a number of architectures. For example, the processor 610 may be a CISC (Complex Instruction Set Computers) processor, a RISC (Reduced Instruction Set Computer) processor, or a MISC (Minimal Instruction Set Computer) processor.

In one implementation, the processor 610 is a single-threaded processor. In another implementation, the processor 610 is a multi-threaded processor. The processor 610 is capable of processing instructions stored in the memory 620 or on the storage device 630 to display graphical information for a user interface on the input/output device 640.

The memory 620 stores information within the controller 600. In one implementation, the memory 620 is a computer-readable medium. In one implementation, the memory 620 is a volatile memory unit. In another implementation, the memory 620 is a non-volatile memory unit.

The storage device 630 is capable of providing mass storage for the controller 600. In one implementation, the storage device 630 is a computer-readable medium. In various different implementations, the storage device 630 may be a floppy disk device, a hard disk device, an optical disk device, or a tape device.

The input/output device 640 provides input/output operations for the controller 600. In one implementation, the input/output device 640 includes a keyboard and/or pointing device. In another implementation, the input/output device 640 includes a display unit for displaying graphical user interfaces.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

The following examples are innovative:

Example 1 is a method that includes lifting a first plunger within a production string disposed within a wellbore formed in a subterranean zone, the production string extending from a wellhead and comprising a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, wherein the lifting comprises lifting the first plunger in a first stage of the plurality of stages to lift production fluid accumulated uphole of the first plunger; continuing to lift the first plunger until the first plunger strikes the intermediate one of the plurality of landing assemblies, allowing the production fluid to flow past the second one of the plurality of landing assemblies into a second stage of the plurality of stages; securing, with the catcher, the first plunger; and lifting, with the production fluid accumulated uphole of a second plunger residing in the second stage, the second plunger to lift the production fluid toward the wellhead.

Example 2 includes example 1, wherein the production string comprises one or more sensors at or near the catcher, the catcher controllable as a function of sensor feedback from the one or more sensors, and the securing comprises securing, as a function of the sensor feedback, the first plunger.

Example 3 includes any of examples 1-2, wherein the catcher is fluidly coupled to an actuator or pump through a hydraulic line, the actuator or pump disposed at or near a terranean surface of the wellbore and coupled to a controller electrically coupled to the sensors, and the securing comprises actuating, by the controller, the actuator or pump as a function of the sensor feedback to move the catcher by moving hydraulic fluid through the hydraulic line.

Example 4 includes any of examples 1-3, further comprising releasing the first plunger, allowing the first plunger to fall and land on the first landing assembly for fluid to accumulate on the first plunger.

Example 5 includes any of examples 1-4, the first plunger comprises a bypass plunger defining a fluid pathway extending through the plunger, allowing the production fluid to flow uphole through the first plunger as the first plunger falls in the production string within the first stage.

Example 6 includes any of examples 1-5, wherein the first plunger comprises a bypass valve configured to close when the first plunger lands on the first landing assembly, blocking the fluid pathway, and open when the first plunger reaches the intermediate landing assembly.

Example 7 includes any of examples 1-6, wherein the second stage is defined between the intermediate landing assembly and the wellhead, and the lifting comprises lifting the production fluid to the terranean surface of the wellbore through the wellhead.

Example 8 includes any of examples 1-7, wherein the production string comprises a retrievable tool residing downhole of and adjacent the intermediate landing assembly, the retrievable tool comprising an outwardly projecting pocket defining a fluid pathway extending from the first stage to the second stage, and wherein continuing to lift the first plunger comprises lifting the first plunger to push, with the first plunger, the production fluid along the fluid pathway into the second stage.

Example 9 is method that includes receiving, by a system comprising one or more computers in one or more locations, first sensor feedback from one or more sensors attached to a production string disposed within a wellbore; and transmitting, by the system and as a function of the first sensor feedback, instructions to a controller to activate the controller, the controller configured to actuate, as a function of the instructions, an actuator or pump fluidly coupled to a downhole catcher to actuate the downhole catcher and catch a first plunger with the downhole catcher, wherein the production string comprises a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, the downhole catcher residing downhole of the intermediate landing assembly in a first stage of the plurality of stages.

Example 10 includes example 9, further comprising transmitting, by the system and as a function of a second sensor feedback, instructions to a controller to activate the controller, the controller configured to actuate, as a function of the instructions, the actuator or pump to actuate the catcher and release the first plunger after production fluid uphole of the first plunger has been flowed from the first stage to the second stage.

Example 11 includes any of examples 9-10, wherein the second sensor feedback comprises one of pressure feedback, temperature feedback, or motion feedback.

Example 12 includes any of examples 9-11, wherein the controller is configured to actuate a pump coupled to a hydraulic line, and the transmitting comprises transmitting instructions to the controller to cause the controller to actuate the pump to move hydraulic fluid along the hydraulic line to move the downhole catcher.

Example 13 includes any of examples 9-12, wherein the first sensor feedback comprises motion feedback.

Example 14 is a wellbore assembly, comprising: a production string configured to be disposed within a wellbore formed in a subterranean zone, the production string configured to be fluidly coupled to a wellhead residing at a terranean surface of the wellbore; a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, a plurality of plungers, each plunger configured to reside in the production string in a respective one of the plurality of stages; and a catcher configured to reside downhole of the intermediate landing assembly and configured to catch a first plunger of the plurality of plungers after the first plunger has been lifted to push production fluid uphole past a second plunger resting on the intermediate landing assembly.

Example 15 includes example 14, wherein the plurality of stages comprises a first stage and a second stage uphole of and adjacent the first stage, the first stage defined between the first landing assembly and the intermediate landing assembly, the catcher and the first plunger residing in the first stage.

Example 16 includes any of examples 14-15, further comprising a retrievable tool residing in the first stage downhole of and adjacent the intermediate landing assembly, the retrievable tool comprising an outwardly projecting pocket defining a fluid pathway extending from the first stage to the second stage, the first plunger configured to be along the first stage to push the production fluid uphole along the fluid pathway into the second stage to accumulate on the second plunger.

Example 17 includes any of examples 14-16, wherein the retrievable tool comprises one or more sensors and the catcher, the catcher controllable as a function of sensor feedback from the one or more sensors.

Example 18 includes any of examples 14-17, wherein the catcher is fluidly coupled to an actuator or pump through a hydraulic line, the actuator or pump disposed at or near a terranean surface of the wellbore and coupled to a controller electrically coupled to the sensors, and the securing comprises actuating, by the controller, the actuator or pump as a function of the sensor feedback to move the catcher by moving hydraulic fluid through the hydraulic line.

Example 19 includes any of examples 14-18, wherein the first plunger is a bypass plunger defining a fluid pathway extending through the plunger, allowing the production fluid to flow uphole through the first plunger as the first plunger falls in the production string within the first stage.

Example 20 includes any of examples 14-19, wherein the first plunger comprises a bypass valve configured to close when the first plunger lands on the first landing assembly, blocking the fluid pathway, and open when the first plunger reaches the intermediate landing assembly.

What is claimed is:

1. A method, comprising:

lifting a first plunger within a production string disposed within a wellbore formed in a subterranean zone, the production string extending from a wellhead and comprising a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, wherein the lifting comprises lifting the first plunger in a first stage of the plurality of stages to lift production fluid accumulated uphole of the first plunger;

continuing to lift the first plunger until the first plunger strikes the intermediate one of the plurality of landing assemblies, allowing the production fluid to flow past the second one of the plurality of landing assemblies into a second stage of the plurality of stages;

securing, with a controllable catcher, the first plunger to retain the first plunger and prevent the first plunger from traveling in a downhole direction; and lifting, with the production fluid accumulated uphole of a second plunger residing in the second stage, the second plunger to lift the production fluid toward the wellhead.

2. The method of claim 1, wherein the production string comprises one or more sensors at or near the catcher, the catcher controllable as a function of sensor feedback from the one or more sensors, and the securing comprises securing, as a function of the sensor feedback, the first plunger.

3. The method of claim 1, further comprising releasing the first plunger, allowing the first plunger to fall and land on the first landing assembly for fluid to accumulate on the first plunger.

4. The method of claim 1, wherein the first plunger comprises a bypass plunger defining a fluid pathway extending through the plunger, allowing the production fluid to flow uphole through the first plunger as the first plunger falls in the production string within the first stage.

5. The method of claim 4, wherein the first plunger comprises a bypass valve configured to close when the first plunger lands on the first landing assembly, blocking the fluid pathway, and open when the first plunger reaches the intermediate landing assembly.

6. The method of claim 1, wherein the second stage is defined between the intermediate landing assembly and the wellhead, and the lifting comprises lifting the production fluid to the terranean surface of the wellbore through the wellhead.

7. A method, comprising:

receiving, by a system comprising one or more computers in one or more locations, first sensor feedback from one or more sensors attached to a production string disposed within a wellbore; and transmitting, by the system and as a function of the first sensor feedback, instructions to a controller to activate the controller, the controller configured to actuate, as a function of the instructions, an actuator or pump fluidly coupled to a downhole catcher to actuate the downhole catcher and catch a first plunger with the downhole catcher to prevent the first plunger from traveling in a downhole direction, wherein the production string comprises a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, the downhole catcher residing downhole of the intermediate landing assembly in a first stage of the plurality of stages.

8. The method of claim 7, wherein the first sensor feedback comprises motion feedback.

9. A wellbore assembly, comprising:

a production string configured to be disposed within a wellbore formed in a subterranean zone, the production string configured to be fluidly coupled to a wellhead residing at a terranean surface of the wellbore;

a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, a plurality of plungers, each plunger configured to reside in the production string in a respective one of the plurality of stages; and a catcher configured to reside downhole of the intermediate landing assembly and configured to catch a first plunger of the plurality of plungers after the first plunger has been lifted to push production fluid uphole past a second plunger resting on the intermediate landing assembly, the catcher configured to retain the first plunger of the plurality of plungers to prevent the first plunger of the plurality of plungers from traveling in a downhole direction.

10. The wellbore assembly of claim 9, wherein the plurality of stages comprises a first stage and a second stage uphole of and adjacent the first stage, the first stage defined between the first landing assembly and the intermediate landing assembly, the catcher and the first plunger residing in the first stage.

11. The wellbore assembly of claim 9, wherein the first plunger is a bypass plunger defining a fluid pathway extending through the plunger, allowing the production fluid to flow uphole through the first plunger as the first plunger falls in the production string within the first stage.

12. The wellbore assembly of claim 11, wherein the first plunger comprises a bypass valve configured to close when the first plunger lands on the first landing assembly, blocking the fluid pathway, and open when the first plunger reaches the intermediate landing assembly.

13. The wellbore assembly of claim 9, wherein the production string defines a fluid pathway extending from the first stage to the second stage to allow the production fluid to flow from the first state to the second stage as the first plunger of the plurality of plungers is lifted.

14. A method, comprising:

lifting a first plunger within a production string disposed within a wellbore formed in a subterranean zone, the production string extending from a wellhead and comprising a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, wherein the lifting comprises lifting the first plunger in a first stage of the plurality of stages to lift production fluid accumulated uphole of the first plunger;

continuing to lift the first plunger until the first plunger strikes the intermediate one of the plurality of landing assemblies, allowing the production fluid to flow past the second one of the plurality of landing assemblies into a second stage of the plurality of stages;

securing, with a catcher, the first plunger; and lifting, with the production fluid accumulated uphole of a second plunger residing in the second stage, the second plunger to lift the production fluid toward the wellhead;

wherein the production string comprises one or more sensors at or near the catcher, the catcher controllable as a function of sensor feedback from the one or more sensors, and the securing comprises securing, as a function of the sensor feedback, the first plunger; and wherein the catcher is fluidly coupled to an actuator or pump through a hydraulic line, the actuator or pump disposed at or near a terranean surface of the wellbore and coupled to a controller electrically coupled to the sensors, and the securing comprises actuating, by the controller, the actuator or pump as a function of the sensor feedback to move the catcher by moving hydraulic fluid through the hydraulic line.

15. A method, comprising:

lifting a first plunger within a production string disposed within a wellbore formed in a subterranean zone, the production string extending from a wellhead and comprising a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, wherein the lifting comprises lifting the first plunger in a first stage of the plurality of stages to lift production fluid accumulated uphole of the first plunger;

continuing to lift the first plunger until the first plunger strikes the intermediate one of the plurality of landing assemblies, allowing the production fluid to flow past the second one of the plurality of landing assemblies into a second stage of the plurality of stages;

securing, with a catcher, the first plunger; and lifting, with the production fluid accumulated uphole of a second plunger residing in the second stage, the second plunger to lift the production fluid toward the wellhead;

wherein the production string comprises a retrievable tool residing downhole of and adjacent the intermediate landing assembly, the retrievable tool comprising an outwardly projecting pocket defining a fluid pathway extending from the first stage to the second stage, and wherein continuing to lift the first plunger comprises lifting the first plunger to push, with the first plunger, the production fluid along the fluid pathway into the second stage.

16. A method, comprising:

receiving, by a system comprising one or more computers in one or more locations, first sensor feedback from one or more sensors attached to a production string disposed within a wellbore; and transmitting, by the system and as a function of the first sensor feedback, instructions to a controller to activate the controller, the controller configured to actuate, as a function of the instructions, an actuator or pump fluidly coupled to a downhole catcher to actuate the downhole catcher and catch a first plunger with the downhole catcher, wherein the production string comprises a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, the downhole catcher residing downhole of the intermediate landing assembly in a first stage of the plurality of stages;

further comprising transmitting, by the system and as a function of a second sensor feedback, instructions to a controller to activate the controller, the controller configured to actuate, as a function of the instructions, the actuator or pump to actuate the catcher and release the first plunger after production fluid uphole of the first plunger has been flowed from the first stage to the second stage.

17. The method of claim 16, wherein the second sensor feedback comprises one of 25. pressure feedback, temperature feedback, or motion feedback.

18. A method, comprising:

receiving, by a system comprising one or more computers in one or more locations, first sensor feedback from one or more sensors attached to a production string disposed within a wellbore; and transmitting, by the system and as a function of the first sensor feedback, instructions to a controller to activate the controller, the controller configured to actuate, as a function of the instructions, an actuator or pump fluidly coupled to a downhole catcher to actuate the downhole catcher and catch a first plunger with the downhole catcher, wherein the production string comprises a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, the downhole catcher residing downhole of the intermediate landing assembly in a first stage of the plurality of stages;

wherein the controller is configured to actuate a pump coupled to a hydraulic line, and the transmitting comprises transmitting instructions to the controller to cause the controller to actuate the pump to move hydraulic fluid along the hydraulic line to move the downhole catcher.

19. A wellbore assembly, comprising:

a production string configured to be disposed within a wellbore formed in a subterranean zone, the production string configured to be fluidly coupled to a wellhead residing at a terranean surface of the wellbore;

a plurality of plunger landing assemblies residing in the production string and dividing the production string into a plurality of stages, each stage comprising a portion of the production string between two consecutive plunger landing assemblies or a plunger landing assembly and the wellhead, the plurality of plunger landing assemblies comprising a first landing assembly and an intermediate landing assembly residing between the first landing assembly and the wellhead, a plurality of plungers, each plunger configured to reside in the production string in a respective one of the plurality of stages; and a catcher configured to reside downhole of the intermediate landing assembly and configured to catch a first plunger of the plurality of plungers after the first plunger has been lifted to push production fluid uphole past a second plunger resting on the intermediate landing assembly, wherein the plurality of stages comprises a first stage and a second stage uphole of and adjacent the first stage, the first stage defined between the first landing assembly and the intermediate landing assembly, the catcher and the first plunger residing in the first stage, further comprising a retrievable tool residing in the first stage downhole of and adjacent the intermediate landing assembly, the retrievable tool comprising an outwardly projecting pocket defining a fluid pathway extending from the first stage to the second stage, the first plunger configured to be along the first stage to push the production fluid uphole along the fluid pathway into the second stage to accumulate on the second plunger.

20. The wellbore assembly of claim 19, wherein the retrievable tool comprises one or more sensors and the catcher, the catcher controllable as a function of sensor feedback from the one or more sensors.

21. The wellbore assembly of claim 20, wherein the catcher is fluidly coupled to an actuator or pump through a hydraulic line, the actuator or pump disposed at or near a terranean surface of the wellbore and coupled to a controller electrically coupled to the sensors, and the securing comprises actuating, by the controller, the actuator or pump as a function of the sensor feedback to move the catcher by moving hydraulic fluid through the hydraulic line.

* * * * *